US005438235A

United States Patent [19]

Sommerer et al.

[11] Patent Number: 5,438,235

[45] Date of Patent: Aug. 1, 1995

[54] ELECTROSTATIC SHIELD TO REDUCE WALL DAMAGE IN AN ELECTRODELESS HIGH INTENSITY DISCHARGE LAMP

[75] Inventors: Timothy J. Sommerer, Ballston Spa; Hseuh-Rong Chang, Scotia; Arthur Klein, III, Rotterdam Junction; Victor D. Roberts; Harald L. Witting, both of Burnt Hills; George A. Farrall, Rexford, all of N.Y.

[73] Assignee: General Electric Company, Schenectady, N.Y.

[21] Appl. No.: 131,544

[22] Filed: Oct. 5, 1993

[51] Int. Cl.[6] ..... H01J 61/00; H01J 61/35

[52] U.S. Cl. ..... 313/489; 313/635; 313/607; 313/234; 313/313; 315/85; 315/248

[58] Field of Search ..... 313/313, 489, 635, 607, 313/608, 234; 315/85, 248

[56] References Cited

U.S. PATENT DOCUMENTS 4,727,295 2/1988 Postma et al. ..... 315/85
5,270,615 12/1993 Chung ..... 313/635

*Primary Examiner*—Michael Horabik
*Assistant Examiner*—N. D. Patel
*Attorney, Agent, or Firm*—Jill M. Breedlove; Marvin Snyder

[57] ABSTRACT

An electrostatic shield is provided between the induction coil and the arc tube of an electrodeless HID lamp. In one embodiment, the shield is a transparent glass cylinder coated with a thin, transparent, conductive layer of tin oxide. In another embodiment, the electrostatic shield is a conductive, transparent tin oxide coating applied to either the inner or outer surface of an outer light-transmissive jacket surrounding the arc tube. The tin oxide layer is discontinuous so as to minimize currents induced in the conductive tin oxide layer by the induction coil. The thickness of the tin oxide layer is sufficient to make it conductive and form an approximately equipotential surface, thereby shielding the arc tube and plasma discharge from intense electric fields, reducing arc tube wall damage and increasing lamp life. In addition, tin oxide functions as an infrared reflector which returns infrared radiation to the arc tube, resulting in higher efficacy. Other advantages of the electrostatic shield include: a lower color temperature, further improving efficacy; and a lower rate of free iodine formation in lamps employing metal iodide fills, further reducing wall damage.

14 Claims, 7 Drawing Sheets

ELECTROSTATIC SHIELD TO REDUCE WALL DAMAGE IN AN ELECTRODELESS HIGH INTENSITY DISCHARGE LAMP

FIELD OF THE INVENTION

The present invention relates generally to electrodeless high intensity discharge (HID) lamps and, more particularly, to an electrostatic shield for reducing capacitive electric field coupling between the plasma arc discharge and the induction coil of such a lamp, thereby improving lamp performance and reducing damage to the arc tube wall and extending the useful life of the lamp.

BACKGROUND OF THE INVENTION

In operation of a high intensity discharge lamp, visible radiation is emitted by the fill at relatively high pressure upon excitation typically caused by passage of current therethrough. One class of high intensity discharge lamps comprises electrodeless lamps which generate an arc discharge by establishing a solenoidal electric field in the high-pressure gaseous lamp fill comprising the combination of one or more metal halides and an inert buffer gas. In particular, the lamp fill, or discharge plasma, is excited by radio frequency (RF) current in an induction coil surrounding an arc tube which contains the fill. The arc tube and induction coil assembly acts essentially as a transformer which couples RF energy to the plasma. That is, the induction coil acts as a primary coil, and the plasma functions as a single-turn secondary. RF current in the induction coil produces a time-varying magnetic field, in turn creating an electric field in the plasma which closes completely upon itself, i.e., a solenoidal electric field. Current flows as a result of this electric field, producing a toroidal arc discharge in the arc tube.

A life-limiting phenomena in an electrodeless HID lamp is damage to the arc tube wall, especially the portion nearest the plasma arc discharge where the capacitively coupled electric field between the arc and the coil is the highest. Much of this damage may be attributed to filamentary discharges which form in the capacitive field between the induction coil and the plasma arc discharge.

Accordingly, it is desirable to reduce the electric field strength between the induction coil and the plasma arc discharge, thereby extending the useful life of the lamp and improving the luminous output therefrom.

SUMMARY OF THE INVENTION

An electrostatic shield is provided between the induction coil and the arc tube of an electrodeless HID lamp. In one embodiment, the shield comprises a transparent glass cylinder coated with a thin, conductive, transparent or translucent layer. A preferred layer comprises tin oxide. In another embodiment, the electrostatic shield comprises a thin, conductive, transparent or translucent coating (e.g., of tin oxide) applied to either the inner or outer surface of an outer light-transmissive jacket surrounding the arc tube. The conductive layer is discontinuous so as to minimize currents induced therein by the induction coil. The thickness of the conductive layer is sufficient to form an approximately equipotential surface, thereby shielding the arc tube and plasma discharge from intense electric fields, reducing arc tube wall damage and increasing lamp life. Preferably, the electrostatic shield also functions as an infrared reflector which returns infrared radiation to the arc tube, resulting in higher efficacy. Other advantages of the electrostatic shield of the present invention include: a lower color temperature, further improving efficacy; and a lower rate of free iodine formation in lamps employing metal iodide fills, further reducing wall damage while improving arc stability.

BRIEF DESCRIPTION OF THE DRAWINGS

The features and advantages of the present invention will become apparent from the following detailed description of the invention when read with the accompanying drawings in which:

FIG. 4*c* is a top view of an alternative embodiment of the lamp of FIG. 4*a* with a tin oxide layer on the outer surface of the outer jacket;

DETAILED DESCRIPTION OF THE INVENTION

Figure 1:
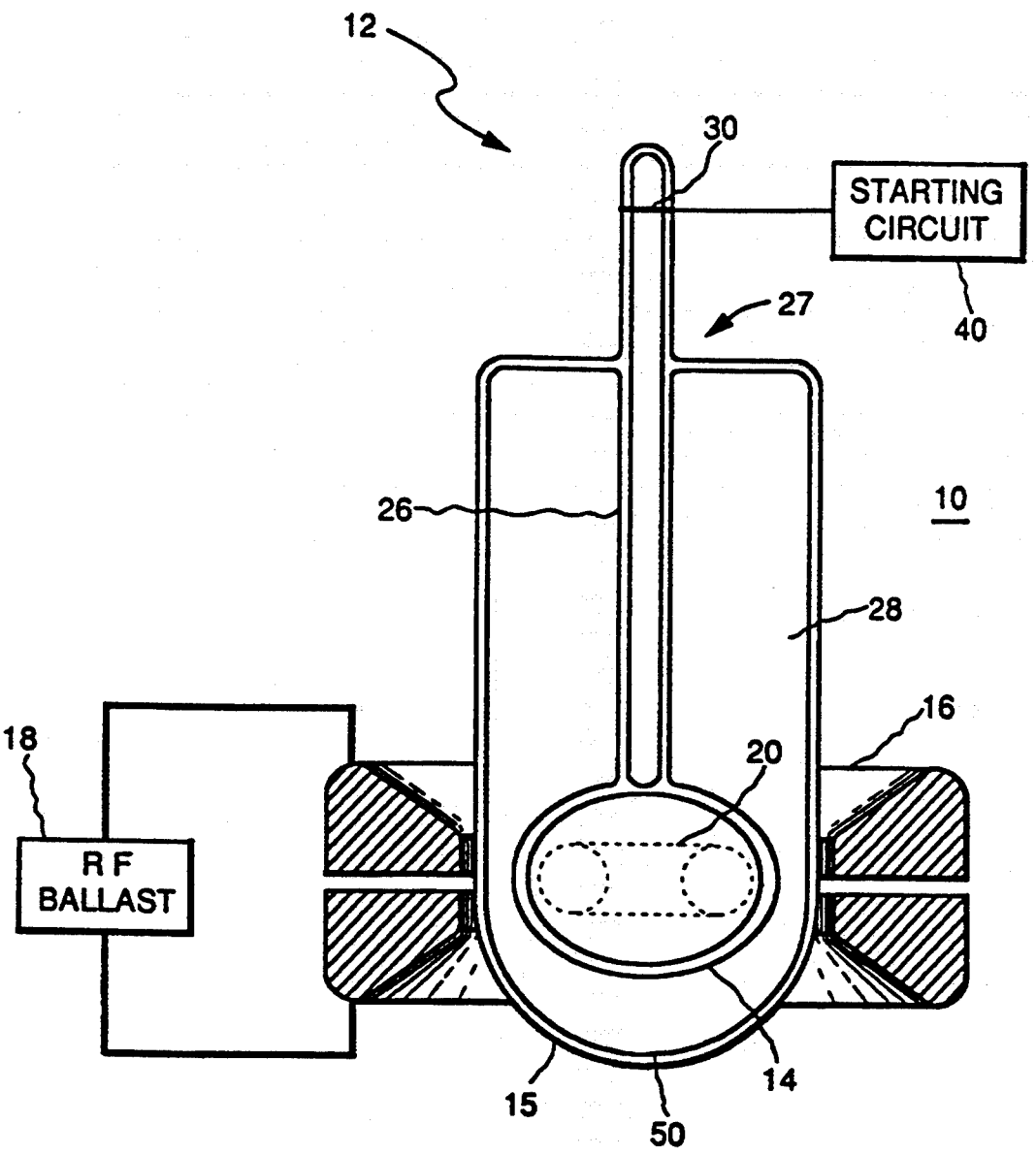
FIG. 1 is a cross sectional view of an exemplary electrodeless HID lamp.

FIG. 1 illustrates a typical electrodeless HID lamp 10. As shown, HID lamp 10 includes an arc tube 14 preferably formed of a high temperature glass, such as fused quartz, or an optically transparent or translucent ceramic, such as polycrystalline alumina. Typically, as shown, a light-transmissive envelope 15 surrounds arc tube 14 in order to reduce heat loss from the arc tube and to protect the arc tube wall from harmful surface contamination. An induction coil 16 is disposed about arc tube 14, i.e., outside envelope 15, and is coupled to a radio frequency (RF) ballast 18 for exciting a toroidal arc discharge 20 therein. Suitable operating frequencies for RF ballast 18 are in the range from 0.1 to 300 megahertz (MHz), exemplary operating frequencies being 6.78 MHz and 13.56 MHz.

By way of example, arc tube 14 is shown as having a substantially ellipsoid shape. However, arc tubes of other shapes may be desirable, depending upon the application. For example, arc tube 14 may be spherical or may have the shape of a short cylinder, or "pillbox" having rounded edges, if desired A suitable arc tube fill is described in commonly assigned U.S. Pat. No. 4,810,938 of P. D. Johnson, J. T.

Dakin and J. M. Anderson, issued on Mar. 7, 1989, which patent is incorporated by reference herein. The fill of the Johnson et al. patent comprises a sodium halide, a cerium halide and xenon combined in weight proportions to generate visible radiation exhibiting high efficacy and good color rendering capability at white color temperatures. For example, such a fill according to the Johnson et al. patent may comprise sodium iodide and cerium chloride, in equal weight proportions, in combination with xenon at a partial pressure of about 500 torr. Another suitable fill is described in commonly assigned U.S. Pat. No. 4,972,120 of H. L. Witting, issued Nov. 20, 1990, which patent is also incorporated by reference herein. The fill of the Witting patent comprises a combination of a lanthanum halide, a sodium halide, a cerium halide and xenon or krypton as a buffer gas. For example, a fill according to the Witting patent may comprise a combination of lanthanum iodide, sodium iodide, cerium iodide, and 250 torr partial pressure of xenon. Metal halide fills are given by way of example only; other types of fills may be suitable, e.g., sodium.

As illustrated in FIG. 1, RF power is applied to the HID lamp by RF ballast 18 via induction coil 16 coupled thereto. Induction coil 16 is illustrated as comprising a two-turn coil having a configuration such as that described in U.S. Pat. No. 5,039,903 of G. A. Farrall, issued Aug. 13, 1991 and incorporated by reference herein. Such a coil configuration results in very high efficiency and causes minimal light blockage from the lamp. The overall shape of the induction coil of the Farrall patent is generally that of a surface formed by rotating a bilaterally symmetrical trapezoid about a coil center line situated in the same plane as the trapezoid, but which line does not intersect the trapezoid. However, other suitable coil configurations may be used, such as that described in commonly assigned U.S. Pat. No. 4,812,702 of J. M. Anderson, issued Mar. 14, 1989, which patent is incorporated by reference herein. In particular, the Anderson patent describes a coil having six turns which are arranged to have a substantially V-shaped cross section on each side of a coil center line. Another suitable induction coil may be of solenoidal shape, for example. Still another suitable induction coil may be of a spiral type which conforms to, but is spaced apart from, at least a portion of the arc tube.

Arc tube 14 is illustrated as being supported within outer envelope 15 by an elongated, tubular support 26. According to one preferred embodiment, the arc tube wall and tubular support are each comprised of quartz. The tubular support extends through an opening at region 27 in the upper end of the outer envelope and is fused about its outer periphery to the upper end of the envelope to form a vacuum-tight seal. The space 28 between the outer envelope and the arc tube may be filled with an inert gas such as, for example, nitrogen or argon. Alternatively, space 28 may be evacuated.

In the lamp of FIG. 1, tubular support 26 for arc tube 14 serves as a discharge starting aid of the type comprising a gas probe starter 12. Such a starting aid is described in commonly assigned U.S. Pat. No. 5,095,249 of V. D. Roberts et al., issued Mar. 10, 1990, which is incorporated by reference herein. The gas probe starter of V. D. Roberts et al. includes a starting electrode 30 coupled to a starting chamber, i.e., tubular support 26, which is attached to the outer wall of arc tube 14 and contains a gas. Specifically, starting electrode 30 is shown being situated about starting chamber, or support, 26 and in contact therewith. However, other suitable configurations (not shown) include situating the electrode either within the interior of the chamber or outside the chamber, but in close proximity thereto.

The gas in the starting chamber, or support 26, may comprise, for: example, a rare gas, such as neon, krypton, xenon, argon, helium, or mixtures thereof, at a pressure in the range from approximately 0.5 to 500 torr, a preferred range being from approximately 5 to 40 torr. Preferably, the gas in chamber 26 is at a relatively low pressure as compared with that of the arc tube fill in order to promote even easier starting. For example, a suitable arc tube fill pressure may be approximately 200 torr while that of the gas in chamber 26 may be approximately 20 torr.

In order to start lamp 10, a starting voltage is applied to electrode 30 via a starting circuit 40, causing the gas in chamber 26 to break down, or ionize, and thus become conductive. The discharge in the starting chamber may be characterized as either a glow discharge or an arc discharge, depending upon the pressure of the gas in chamber 26. At the low-end of the aforementioned gas pressure range, the discharge is more likely to be characterized as a glow, while at the high-end of the gas pressure range, the discharge is more likely to be characterized as an arc. However, there is no generally accepted definition which distinguishes between glow and arc discharges. For example, as described by John H. Ingold in "Glow Discharges at DC and Low Frequencies" from Gaseous Electronics, vol. I, edited by M. N. Hirsh and H. J. Oskam, Academic Press, New York, 1978, pp. 19–20, one definition is based on electrode-related phenomena, and another is based on electron and particle temperatures.

As a result of the discharge current in the starting chamber, i.e., tubular support 26, a sufficiently high starting voltage is capacitively coupled to the inside surface of arc tube 14 which causes the high-pressure gaseous fill contained therein to break down, thereby initiating arc discharge 20. Thereafter, discharge 20 is maintained by the flow of RF current in coil 16 via the time-varying magnetic field and solenoidal electric field resulting therefrom.

In accordance with the present invention, an electrodeless HID lamp is provided with an electrostatic shield for reducing the electric field between the plasma arc discharge and the induction coil. As a result, damage to the arc tube wall is avoided, extending the useful life of the lamp. Such an electrostatic shield provides the additional advantages of: increased efficacy; a lower color temperature; and a lower rate of free iodine formation.

Figure 2:
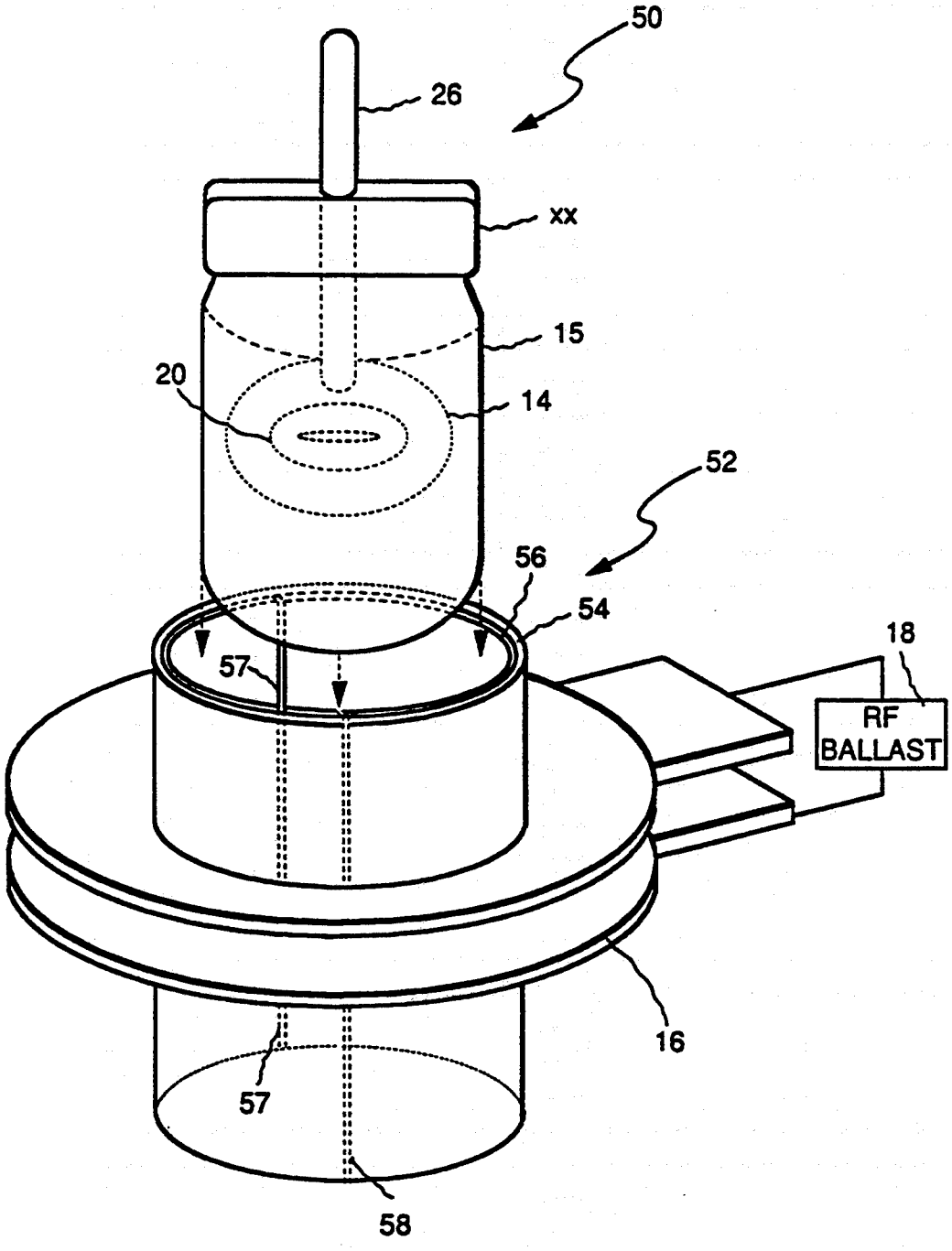
FIG. 2 is an exploded view of an electrodeless HID lamp having an electrostatic shield in accordance with the present invention.

FIG. 2 is an exploded view of an electrodeless HID lamp 50 employing an electrostatic shield 52 between induction coil 16 and discharge 20 in accordance with the present invention. In the embodiment of FIG. 2, electrostatic shield 52 comprises a transparent cylinder 54 (e.g., made of glass), the inner surface of which is coated with a thin, transparent or translucent, conductive layer 56 exhibiting high temperature stability. A preferred layer 56 also functions as an infrared reflector. An exemplary layer 56 comprises tin oxide.

As shown, layer 56 is made discontinuous so as to minimize currents otherwise induced therein by induction coil 16. In particular, layer 56 is illustrated as having two longitudinal cuts 57 and 58 formed therein. Although layer 56 is relatively thin, it is sufficiently thick to be conductive and form an approximately equipotential surface, thereby shielding the arc tube and plasma discharge from intense electric fields due to RF current in the induction coil. According to one embodiment, shield 52 may be integral with induction coil 16.

EXAMPLE I

Figure 3A:
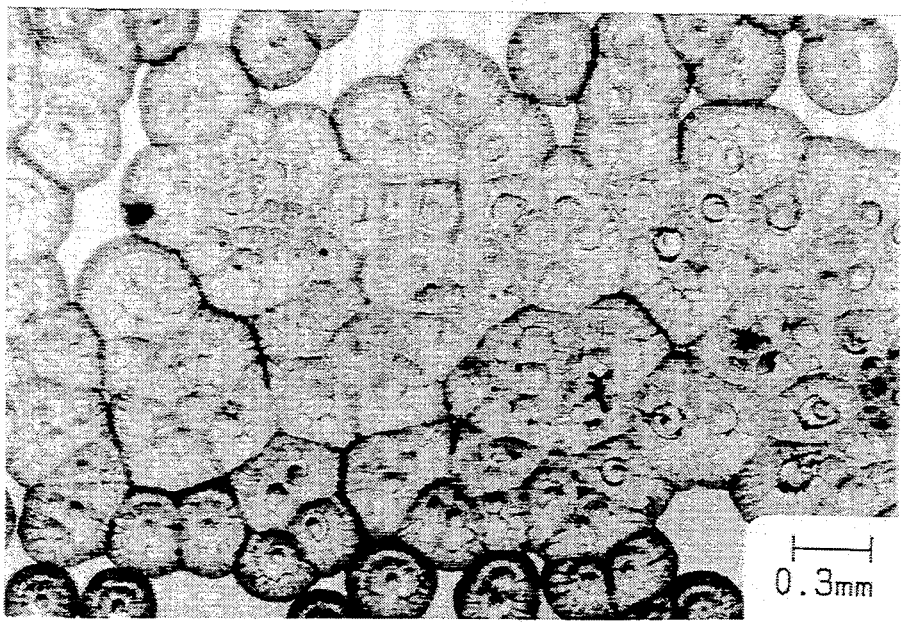
FIGS. 3*a* and 3*b* are photographic illustrations of the regions nearest the arc discharge in two electrodeless HID lamps, one without an electrostatic shield and one with an electrostatic shield, respectively.
Figure 3B:
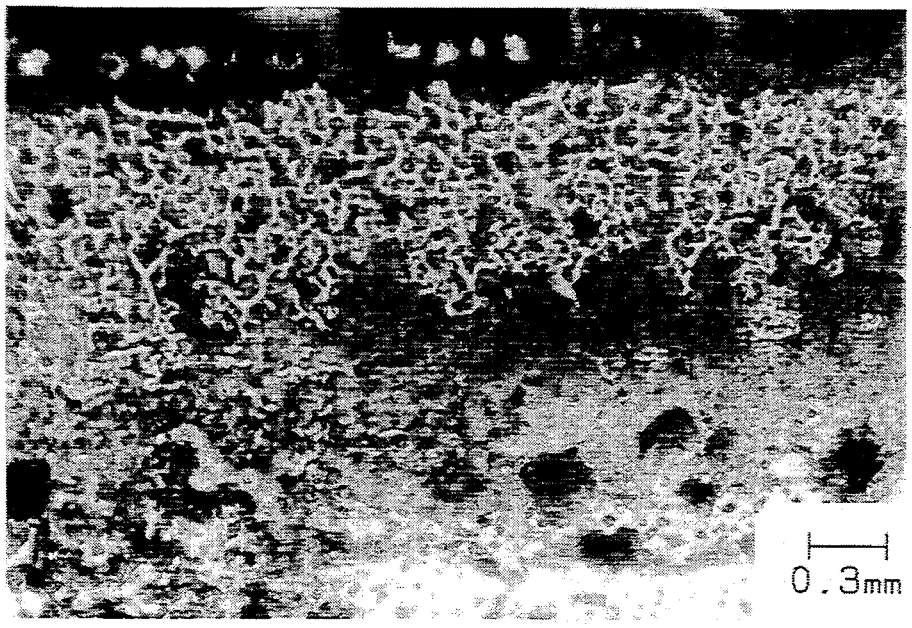

FIGS. 3*a* and 3*b* are photographic illustrations of the regions nearest the arc discharge in two electrodeless HID lamps, one without an electrostatic shield and one with an electrostatic shield such as that of FIG. 2, respectively. The two lamps were each dosed with 8 mg $CsI_3/PrI_3$ in a 1:1 molar ratio. Each was operated in a two-turn copper induction coil with a 34 mm inside diameter. After operating for 500 hours at 350 coil Watts, the photographs of FIGS. 3*a* and 3*b* were taken using an optical microscope looking at the damage from outside the lamp. The region nearest the arc discharge (referred to as the equatorial region) in the lamp operated without an electrostatic shield, as illustrated in FIG. 3*a*, reveals rosette patterns, indicating devitrification of the arc tube wall at sites wherein quartz has nucleated on an impurity. Advantageously, as seen in FIG. 3*b*, there is no such damage in the equatorial region of the lamp operated with an electrostatic shield in accordance with the present invention.

Figure 4A:
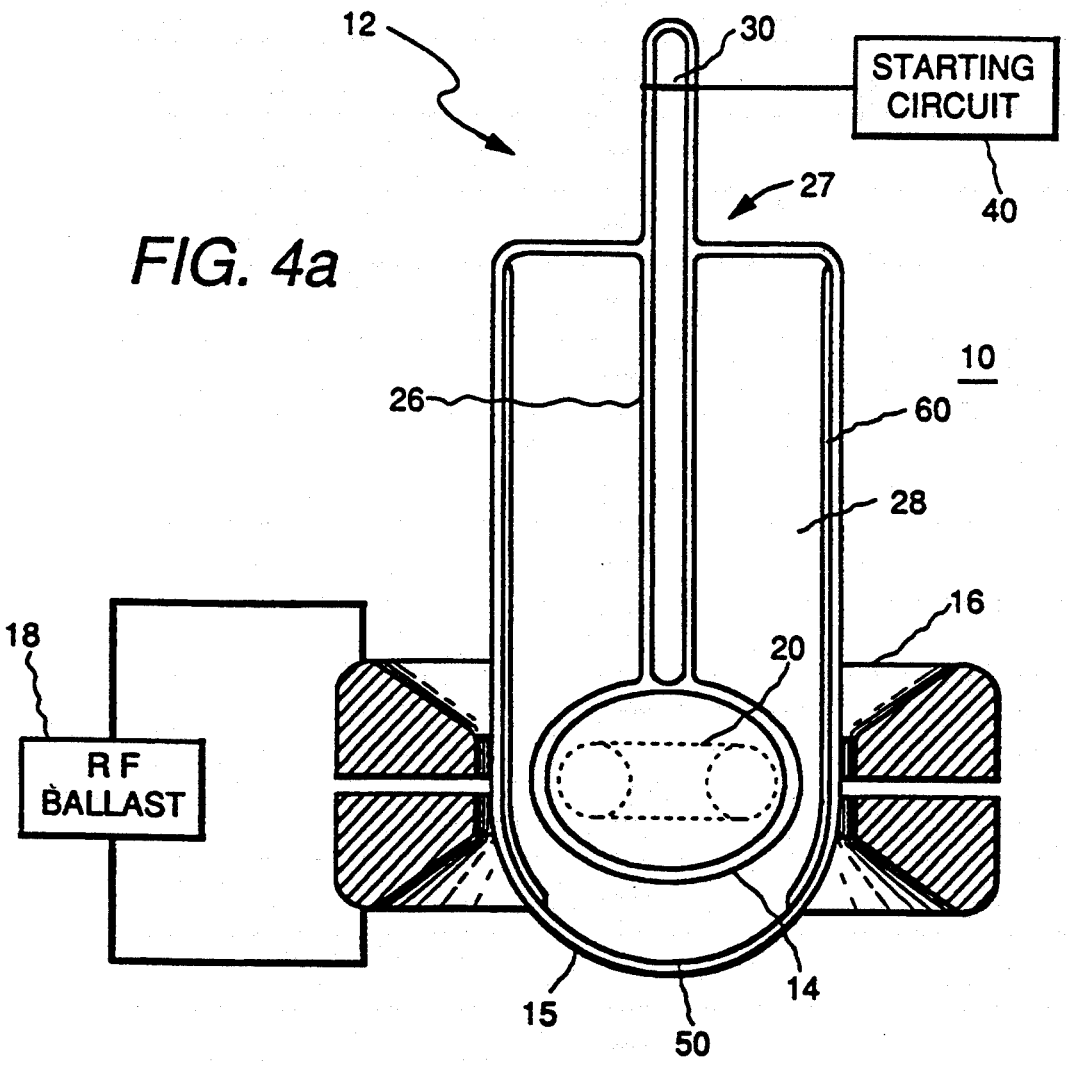
FIG. 4*a* illustrates an alternative embodiment of an electrodeless HID lamp having an electrostatic shield in accordance with the present invention.
Figure 4B:
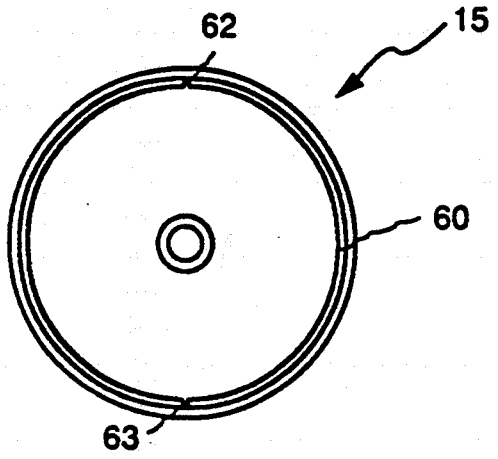
FIG. 4*b* is a top view of the lamp of FIG. 4*a;*

In an alternative embodiment of the present invention, as illustrated in FIGS. 4*a* and 4*b*, an electrostatic shield may comprise a discontinuous tin oxide layer 60 on the inner surface of outer jacket 15. (Alternatively, a tin oxide layer 60' could be applied to the outer surface of outer jacket 15, if desired.) Like shield 52 of FIG. 2, tin oxide layer 60 has two longitudinal cuts 62 and 63 formed therein to minimize currents induced therein.

EXAMPLE II

Two lamps A and B, each having a sodium iodide (NaI) and neodymium iodide ($NdI_3$) dose, were tested. Each lamp has an ellipsoid arc tube of 19 mm×26 mm and an outer jacket of 33 mm outer diameter filled with nitrogen gas. A transparent thin film of fluorine-doped tin oxide of a thickness of approximately 4 μm was applied to the outer surface of the outer jacket of lamp A using a well-known spray pyrolysis technique. A single, narrow longitudinal break was left in the tin oxide film so as to reduce the power coupled into azimuthally circulating currents in the film. The resistivity of the tin oxide film was measured to be $5\times10^2$ ohm-cm. Each lamp was tested in a two-turn copper coil of 34 mm inner diameter. The power input to the coil was 350 Watts.

Figure 5:
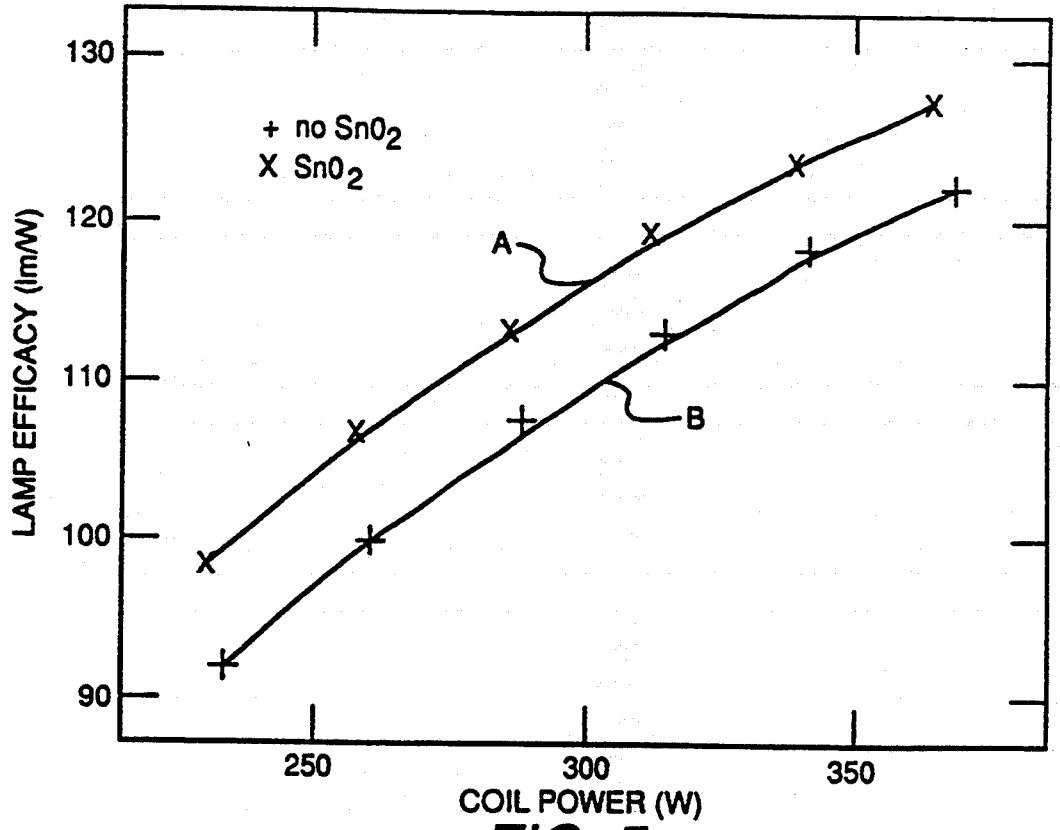
FIG. 5 graphically illustrates lamp efficacy versus coil power for a lamp A using an electrostatic shield in accordance with the present invention and a lamp B without a shield.

FIG. 5 compares the lamp efficacy (visible light output divided by input power to the induction coil) of lamps A and B. Advantageously, lamp efficacy for the lamp (A) with the electrostatic shield was approximately 6–7% higher at the same coil power.

Figure 6:
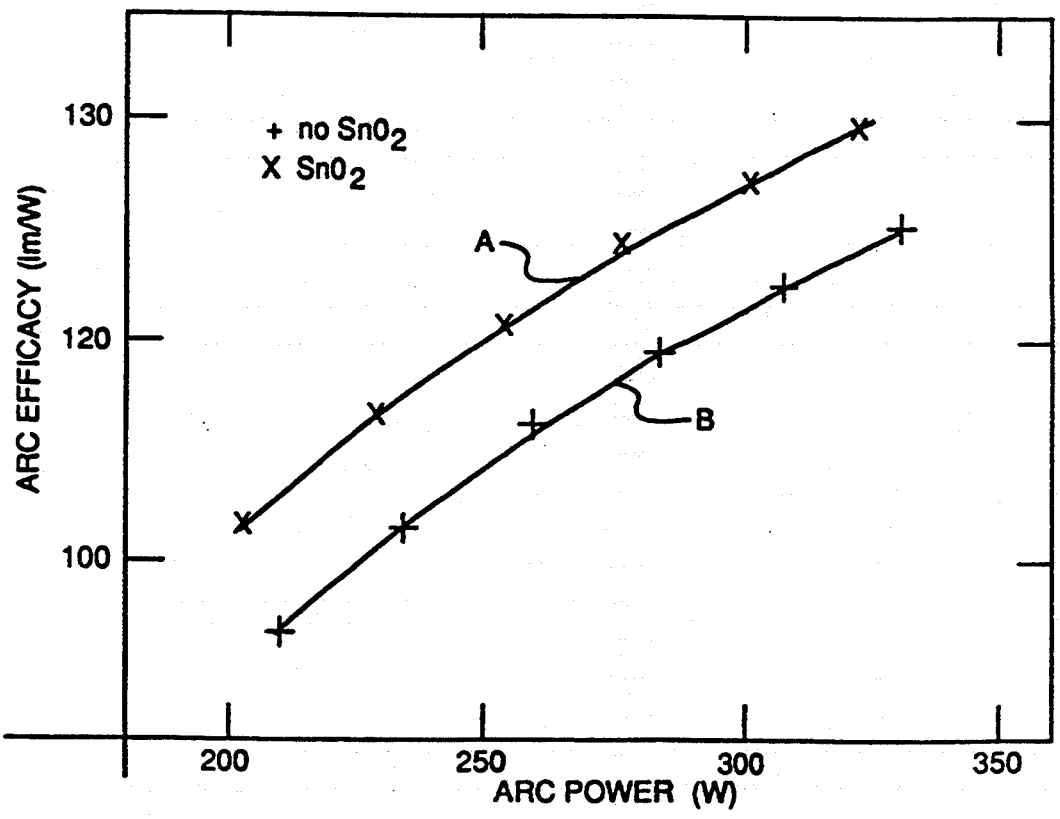
FIG. 6 graphically illustrates arc efficacy versus arc power for lamps A and B.

FIG. 6 compares the arc efficacy (visible light output divided by input power to the arc) of lamps A and B. With the electrostatic shield, arc efficacy was improved by about 10.5%.

Figure 7:
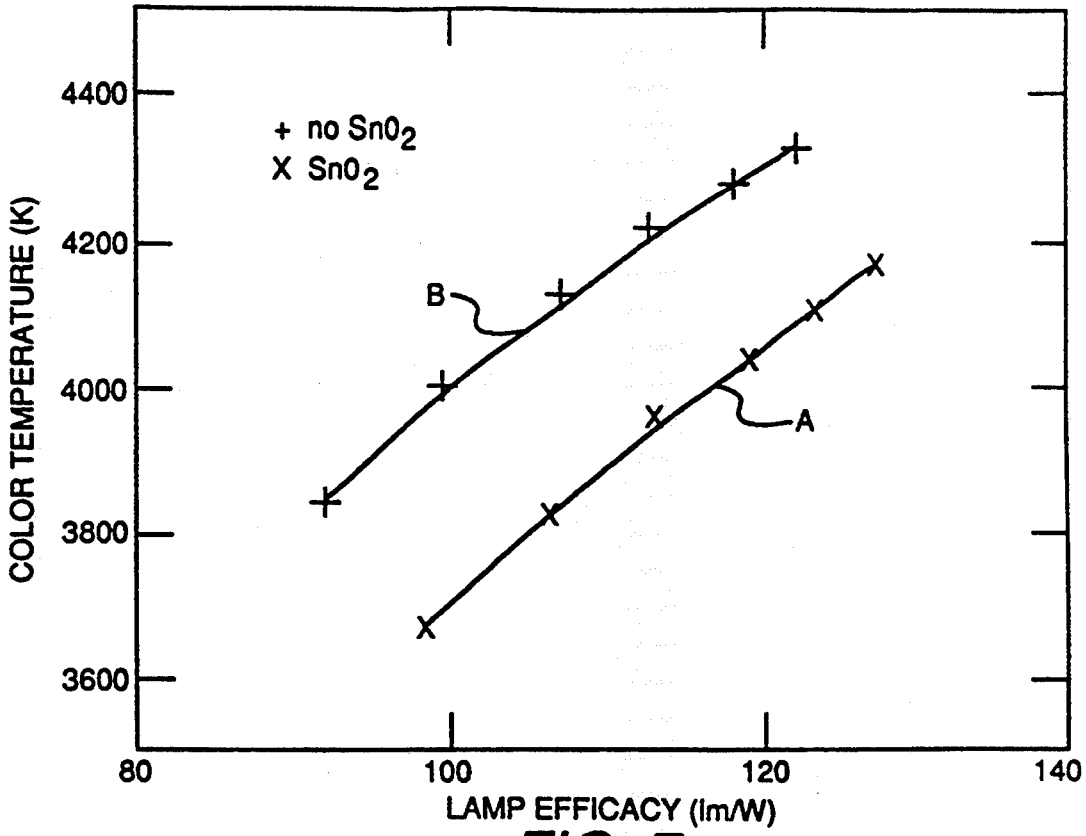
FIG. 7 graphically illustrates color temperature versus lamp efficacy for lamps A and B.

FIG. 7 illustrates color temperature as a function of lamp efficacy. The color temperature of lamp A with the shield was lower than that of lamp B by about 300° C.

Figure 8:
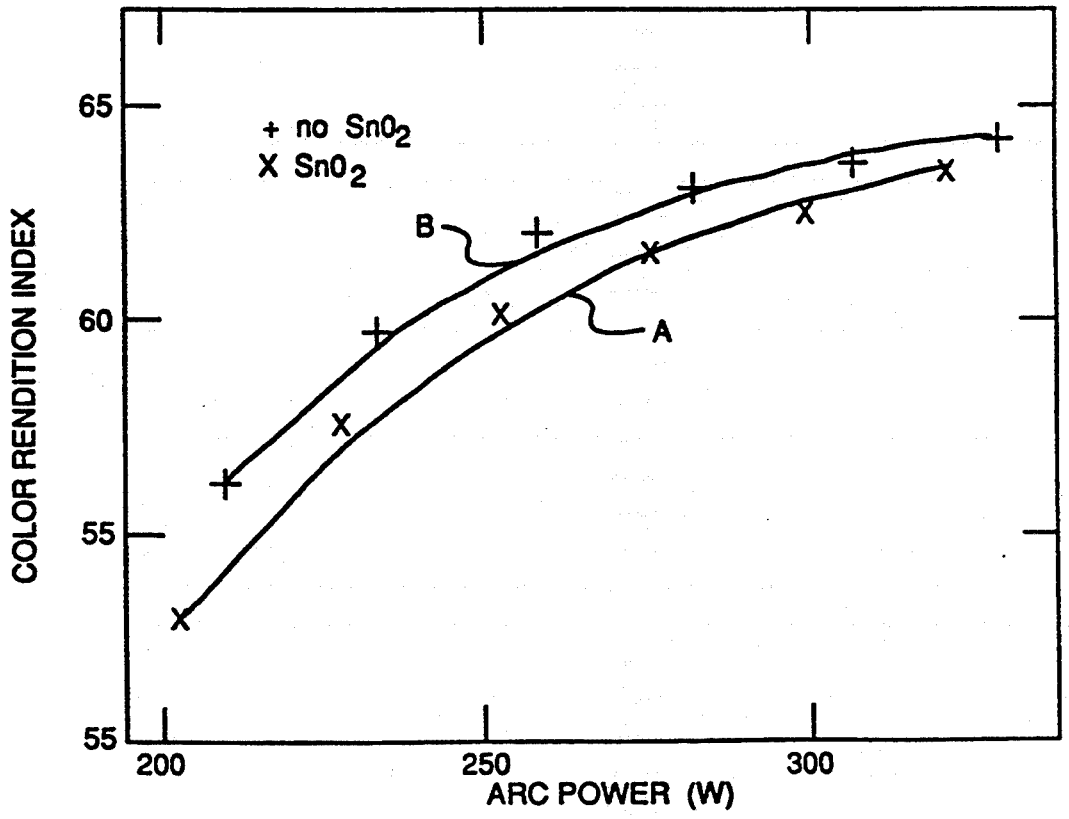
FIG. 8 graphically illustrates color rendition index versus arc power for lamps A and B.
Figure 9:
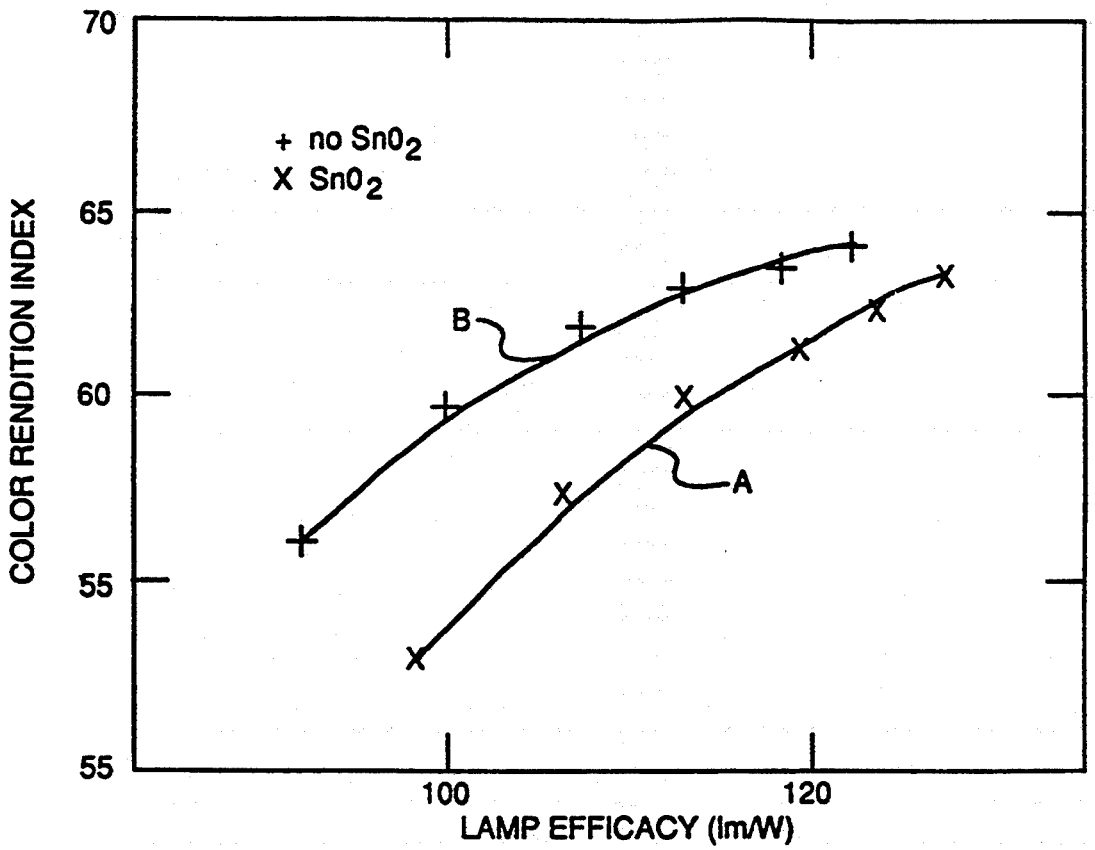
FIG. 9 graphically illustrates color rendition index versus lamp efficacy for a lamps A and B.

FIG. 8 illustrates color rendition index (CRI) as a function of arc power for lamps A and B. The CRI as a function of arc power is similar in lamps with or without the tin oxide layer, e.g., in a range from 61–63 at a coil power of about 300 Watts. However, as illustrated by the graph of FIG. 9, for a given CRI, lamp efficacy for the shielded lamp was significantly higher.

One reason for the increased efficacy in lamps using an electrostatic shield is that the tin oxide film exhibits a high infrared reflectance. Arc tubes used in electrodeless HID lamps typically emit infrared wavelengths in a range from 3 to 10 μm at high temperatures. Coating the outer jacket with tin oxide reflects some off the infrared radiation to the arc tube, resulting in a higher arc tube wall temperature as compared to lamps without such a coating. Since lamp efficacy depends primarily on the fill temperature, which controls the vapor pressure of the radiating species in the lamp, reflecting infrared radiation back to the arc tube results in higher lamp efficacy at a given input power.

Free iodine formed in the arc tubes was measured by absorption spectroscopy at a wavelength of 515 nm, and the results are shown in Table I. At 100 hours, the free iodine level found in the shielded lamp (A) was lower than that in the unshielded lamp (B). Lamp B exhibited arc instability at 434 hours with an iodine absorbance of 0.16. At the same burn time, lamp A still had a stable arc, and the iodine level was lower, 0.09.

TABLE I

| | Comparison of Free Iodine Level in Lamps With and Without an Electrostatic Shield | | |
|---|---|---|---|
| LAMP | 100 HOURS | 434 HOURS | ARC AT 434 HOURS |
| A | 0.06 | 0.09 | STABLE |
| B | 0.08 | 0.16 | UNSTABLE |

A reduction in the free iodine level is directly attributable to the reduction in the electric field by the electrostatic shield. In particular, a reduction of the electric field between the arc and the induction coil results in a reduction of the diffusion rate of metal (e.g., sodium) to the arc tube wall. Therefore, sodium loss from the arc and the formation of free iodine are reduced. As a result, arc tube wall damage is further reduced, and lamp life is extended.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless high intensity discharge lamp, comprising:

a light-transmissive arc tube for containing a fill;

an induction coil situated about said arc tube for exciting a plasma arc discharge in said fill; and an electrostatic shield situated between said arc discharge and said induction coil for minimizing an electric field between said arc discharge and said induction coil during lamp operation.

2. The electrodeless high intensity discharge lamp of claim 1 wherein said electrostatic shield comprises a transparent or translucent, conductive layer disposed on a dielectric surface.

3. The electrodeless high intensity discharge lamp of claim 2 wherein said conductive layer is discontinuous so as to avoid a flow of currents therein.

4. The electrodeless high intensity discharge lamp of claim 2 wherein said conductive layer further comprises an infrared reflector.

5. The electrodeless high intensity discharge lamp of claim 4 wherein said conductive layer comprises tin oxide.

6. The electrodeless high intensity discharge lamp of claim 2 wherein said electrostatic shield comprises a cylindrical shield.

7. The electrodeless high intensity discharge lamp of claim 6 wherein said cylindrical shield comprises glass.

8. The electrodeless high intensity discharge lamp of claim 7 wherein said conductive layer comprises tin oxide.

9. The electrodeless high intensity discharge lamp of claim 1, further comprising a light-transmissive outer jacket surrounding said arc tube, said outer jacket being situated between said arc tube and said induction coil.

10. The electrodeless high intensity discharge lamp of claim 9 wherein said electrostatic shield comprises a tin oxide layer on an inner surface of said outer jacket.

11. The electrodeless high intensity discharge lamp of claim 9 wherein said electrostatic shield comprises a tin oxide layer on an outer surface of said outer jacket.

12. The electrodeless high intensity discharge lamp of claim 1 wherein said electrostatic shield is integral with said induction coil.

13. The electrodeless high intensity discharge lamp of claim 12 wherein said conductive layer has at least one longitudinal cut formed therein.

14. The electrodeless high intensity discharge lamp of claim 1 wherein said fill includes at least one metal halide.

* * * * *